US006786438B2

(12) United States Patent
Winn

(10) Patent No.: US 6,786,438 B2
(45) Date of Patent: Sep. 7, 2004

(54) COMBINATION MODULE FEEDER AND CLEANER FOR COTTON GIN

(76) Inventor: William E. Winn, 1301 First St., Levelland, TX (US) 79336

( * ) Notice: Subject to any disclaimer, the term of this patent is extended or adjusted under 35 U.S.C. 154(b) by 17 days.

(21) Appl. No.: 10/131,087

(22) Filed: Apr. 25, 2002

(65) Prior Publication Data

US 2003/0201351 A1 Oct. 30, 2003

(51) Int. Cl.[7] ..... B02C 19/12

(52) U.S. Cl. ..... 241/65; 19/48 R; 19/64.5; 19/80 R; 241/73; 241/285.2

(58) Field of Search ..... 209/616, 606; 19/64.5, 48 R, 50 R, 39, 44; 241/65, 60, 73, 277, 605, 285.2

(56) References Cited

U.S. PATENT DOCUMENTS 4,974,293 A * 12/1990 Baker
6,038,741 A * 3/2000 Winn
6,314,806 B1 * 11/2001 Ghorashi et al.

OTHER PUBLICATIONS

Kimbell Gin Machinery Company, *KGM Module Feeder*, (date unknown), Lubbock, Texas, Copyright 2001 Kimbell Gin Machinery Co., Inc.

Continental Gin, 6 sheets of engineering drawings (date unknown).

* cited by examiner

*Primary Examiner*—Mark Rosenbaum
(74) *Attorney, Agent, or Firm*—Finnegan, Henderson, Farabow, Garrett & Dunner, L.L.P.

(57) ABSTRACT

A combination module feeder and cleaner for feeding and cleaning modules of seed cotton for ginning that includes a casing having two vertical columns of a plurality of cylinders that rotate about a respective axis, each of the cylinders having spikes disposed along the perimeter thereof to receive the modules of seed cotton. The modules of seed cotton enter the casing, the two rows of spiked cylinders cooperate to break apart the modules, and spiked cylinders adjacent grids wipe the seed cotton along spaced slots to remove trash and other objects from the seed cotton.

11 Claims, 10 Drawing Sheets

COMBINATION MODULE FEEDER AND CLEANER FOR COTTON GIN

BACKGROUND OF THE INVENTION

1. Field of the Invention

The present invention relates generally to cotton gins. More particularly, the present invention relates to a combination module feeder and cleaner for feeding and cleaning modules of seed cotton for use in a cotton gin.

2. Description of the Related Art

Since the cotton gin was first developed by Eli Whitney more than a century ago, the basic task of separating seeds, plant material, and other objects from the fibers of the cotton has remained a primary concern among cotton ginners. These various objects, or "trash," are typically collected together with the raw cotton when it is harvested. This trash must be separated from the cotton fibers before the fibers can be processed into thread and, ultimately, into fabric.

Prior to the raw cotton reaching the cotton ginner, the cotton is often harvested from the cotton plants by a cotton harvesting machine called a picker or stripper. As the pickers remove the raw cotton from the cotton plants, these machines also collect dead leaves and sticks from the plant and the ground surrounding the cotton plants. As the pickers become loaded with the picked cotton, the pickers sometimes transfer the raw cotton into another machine called a module builder. In the module builder, the raw cotton is formed into large blocks of cotton called modules. These modules can often measure as large as 8 feet, by 8 feet, by 32 feet. This form of cotton harvesting has led to the development and use of machines called module feeders for breaking apart the modules of cotton so that the cotton can be cleaned by a cotton gin, for example.

Once the cotton has been formed into modules, the modules are transported to a processing plant for removing the seeds, sticks and leaves, or other trash from the cotton. The system in the processing plant that performs this task is called a cotton gin.

In a conventional cotton gin, the modules are first broken apart by a separate module feeder. Once broken apart, the cotton is in a form called seed cotton and is ready for transport to cleaning and extracting machinery, which removes the trash from the seed cotton. Once the trash has been removed from the seed cotton, the cotton lint is pressed into large bales, sometimes as large as 500 pounds, for distribution to facilities for making cloth.

In a conventional cotton gin having a module feeder, the module feeder, the cleaners and the extractors are separate machines interconnected by a system that conveys the cotton between the machines. Because these are separate machines, they require additional space and may necessitate additional operators. Therefore, for at least these reasons, the conventional cotton gin machines add complexity to the cotton processing operation.

Consequently, there is a need for a machine for performing the operations of a conventional module feeders and cleaners while reducing the complexities associated with the module feeders and cleaners being separate pieces of machinery.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and described herein, the combination module feeder and cleaner for feeding and cleaning cotton modules of the present invention includes a casing having an inlet for receiving modules of seed cotton, and an outlet for expelling the seed cotton after objects have been removed. The combination module feeder and cleaner further includes a conveyer for moving modules of seed cotton into the inlet, a first column of rotatable cylinders positioned adjacent the inlet, a second column of rotatable cylinders positioned adjacent the first column of rotatable cylinders, a saddle positioned adjacent at least one of the rotatable cylinders of the second column of rotatable cylinders, and a grid positioned in the saddle, the grid having spaced slots through which objects pass when removed from the seed cotton.

According to yet another aspect of the invention, a removable module for use in a cotton gin is provided. The removable module includes a casing, a first pair of rotatable cylinders located within the casing, a second pair of rotatable cylinders located within the casing and positioned opposite the first pair of rotatable cylinders, a saddle positioned adjacent each of cylinders of the second pair of rotatable cylinders, a grid located in each saddle, and a connection structure for connecting two or more of the removable modules to each other It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate preferred embodiments of the invention and, together with the description, serve to explain the principles of the invention. In the drawings.

DESCRIPTION OF THE PREFERRED EMBODIMENTS

Reference will now be made in detail to the present embodiments of the invention, examples of which are illustrated in the accompanying drawings. Wherever possible, the same reference numbers will be used throughout the drawings to refer to the same or like parts.

In accordance with the present invention, there is provided a combination module feeder and cleaner for feeding and cleaning modules of seed cotton for ginning that includes a casing having two vertical columns of a plurality of cylinders that rotate about a respective axis and each of the cylinders have spikes disposed along the perimeter thereof to receive the cotton modules. Positioned substantially adjacent one of the columns of cylinders are a plurality of saddles. Housed in each of the plurality of saddles is a corresponding grid including spaced slots. As the modules of seed cotton enter the casing, the two rows of spiked cylinders cooperate to break apart the modules, and the spiked cylinders adjacent the grids wipe the seed cotton along the spaced slots as the spiked cylinders rotate to remove trash and other objects from the seed cotton. The continued rotation of the cylinders convey any seed cotton remaining on the spiked cylinders to the next cylinder in the series of cylinders and eventually to an outlet of the casing.

The configuration of at least one pair of the saddles and grids allows for the rapid removal and replacement of the grid from the saddle. In particular, the grids are designed as a single piece of metal rolled to conform to the configuration of the saddle. By replacing a grid with another grid of spaced slot dimensions more closely corresponding to the characteristics of the seed cotton, the cleaning process is enhanced without undue delay.

Figure 1:
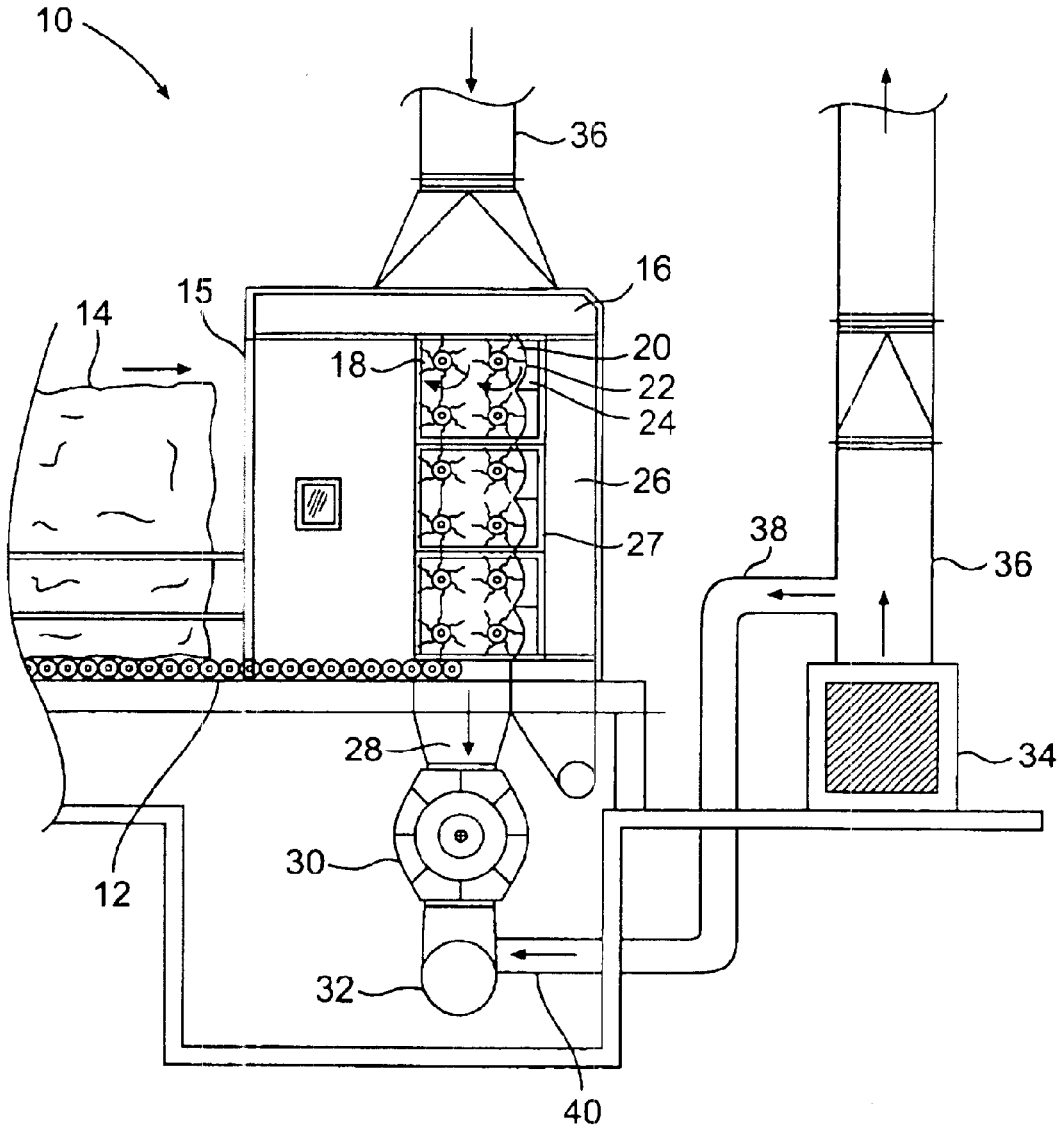
FIG. 1 is a schematic side view illustration of a preferred embodiment of a combination module feeder and cleaner according to the present invention.
Figure 2:
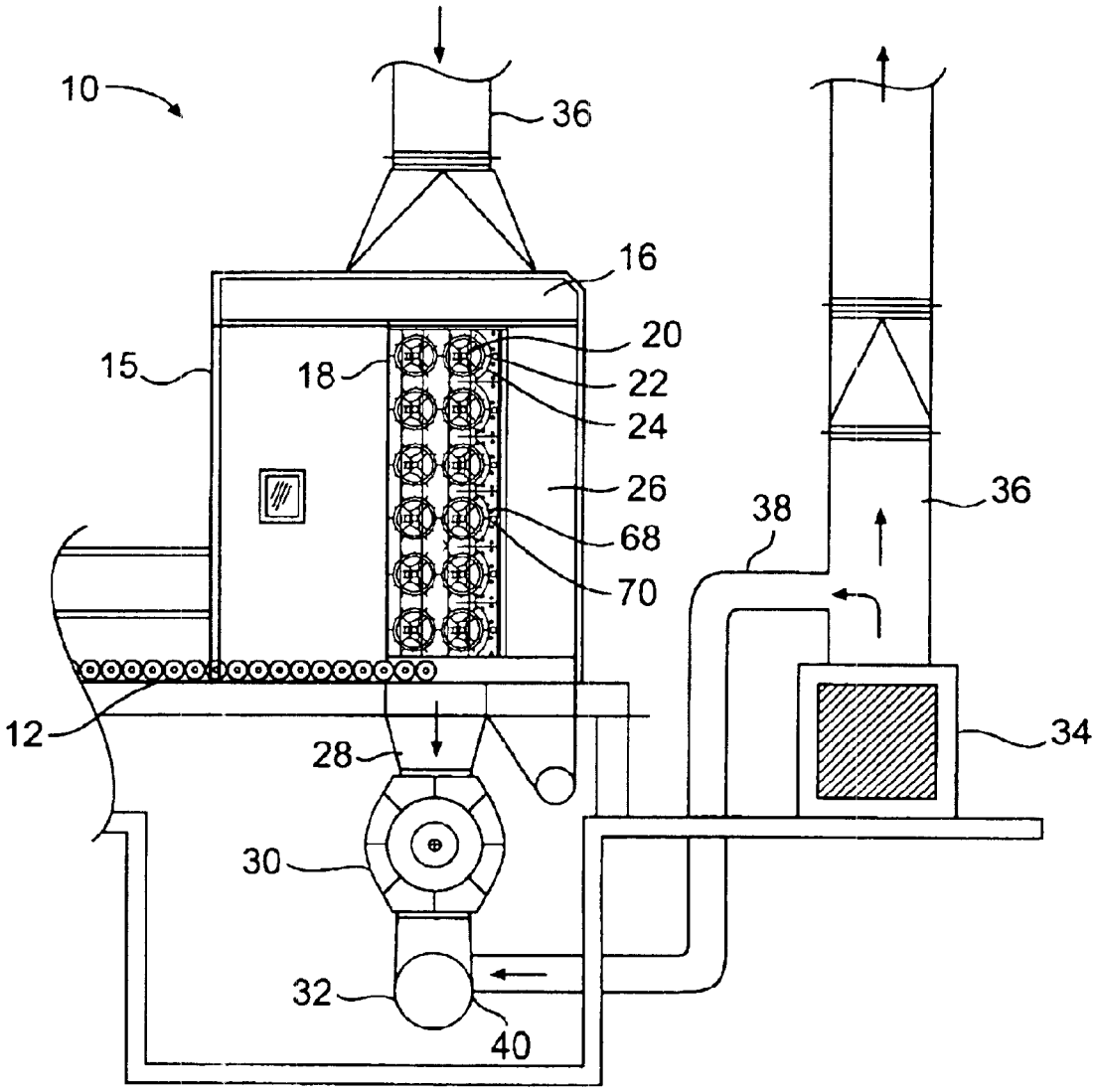
FIG. 2 is a schematic side view illustration of the embodiment shown in FIG. 1.

In the embodiment of the combination module feeder and cleaner of the present invention, as shown in FIG. 1, the combination module feeder and cleaner 10 includes a conveyer 12 for accepting cotton modules 14 and for conveying the modules 14 into the casing 16. The casing 16 includes a first vertical column of spiked cylinders 18 and a second vertical column of spiked cylinders 20. The columns of spiked cylinders 18 and 20 rotate in a clockwise direction as shown. Adjacent the second vertical column of spiked cylinders 20, saddles 22 retain removable grids 24, which provide a passageway into cavity 26.

The casing 16 is connected to a burner 34 through a duct 36. The burner 34 provides warm air for removing moisture from the cotton as it is processed through the combination module feeder and cleaner 10. Warm air from the burner 34 is conveyed through duct 36, into the casing 16, and exits through an outlet 28. Duct 38 interconnects duct 36 with a blow box 32.

During operation, cotton modules 14 travel down the conveyor 12 until they contact the first vertical column of rotating spiked cylinders 18, which break apart the module 12 as it continues to be fed into the casing 16. The second vertical column of spiked cylinders 20 cooperates with the first vertical column of spiked cylinders 18 in breaking apart the modules 12, and further acts to convey the cotton to the removable grids 24. The cotton is wiped across the removable grids 24 as the second vertical column of spiked cylinders 20 rotates, and trash from the cotton is expelled through spaced slots 72 in the grids 24 into the cavity 26, which provides a passage for the trash to fall into a receiving chamber such that the trash can be subsequently removed.

As the trash is removed from the cotton, the cotton travels down the casing 16 and exits at outlet 28, its travel being assisted by a vacuum 30, which conveys the cotton into the blow box 32 for further conveyance to processing machinery in the cotton gin.

Figure 5:
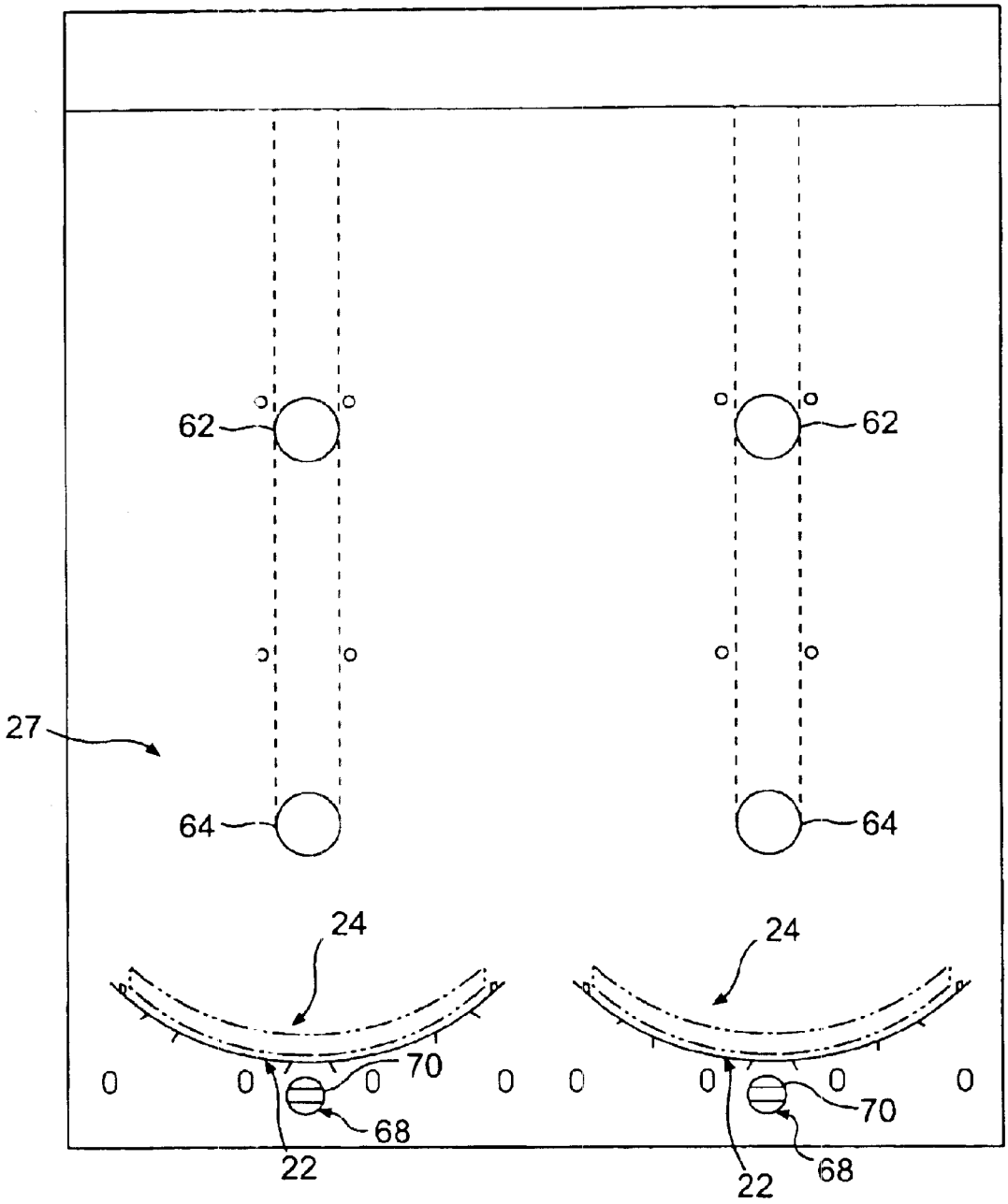
FIG. 5 is a schematic side view illustration of a saddle, grid, port, and tray as incorporated in the present invention.
Figure 6:
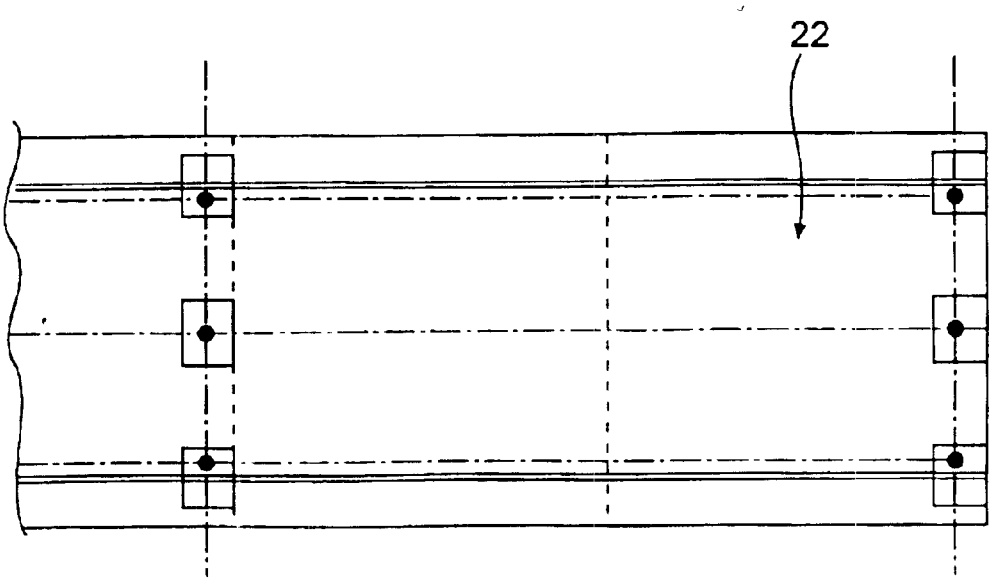
FIG. 6 is a fragmentary top view illustration of the saddle as incorporated in the present invention.

As illustrated in FIGS. 1 and 5, each saddle 22 preferably has a concave structure corresponding to the outer perimeter formed by the rotation of the spiked cylinders of the second vertical column of spiked cylinders 20. The saddle 22 is configured to house the grid 24 and permit the rapid removal and insertion of the grid 24 in the saddle 22.

Figure 3:
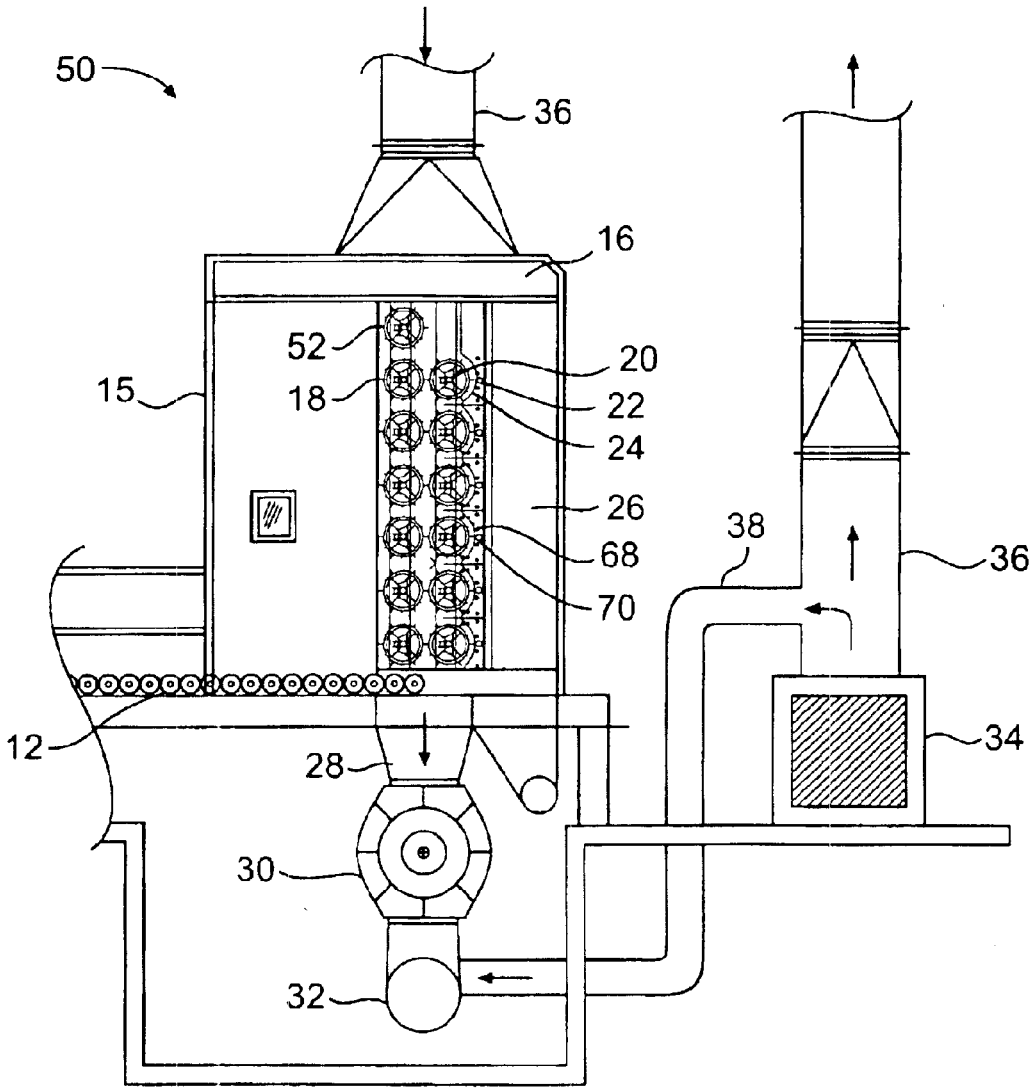
FIG. 3 is a schematic side view illustration of another preferred embodiment of a combination module feeder and cleaner according to the present invention.
Figure 4:
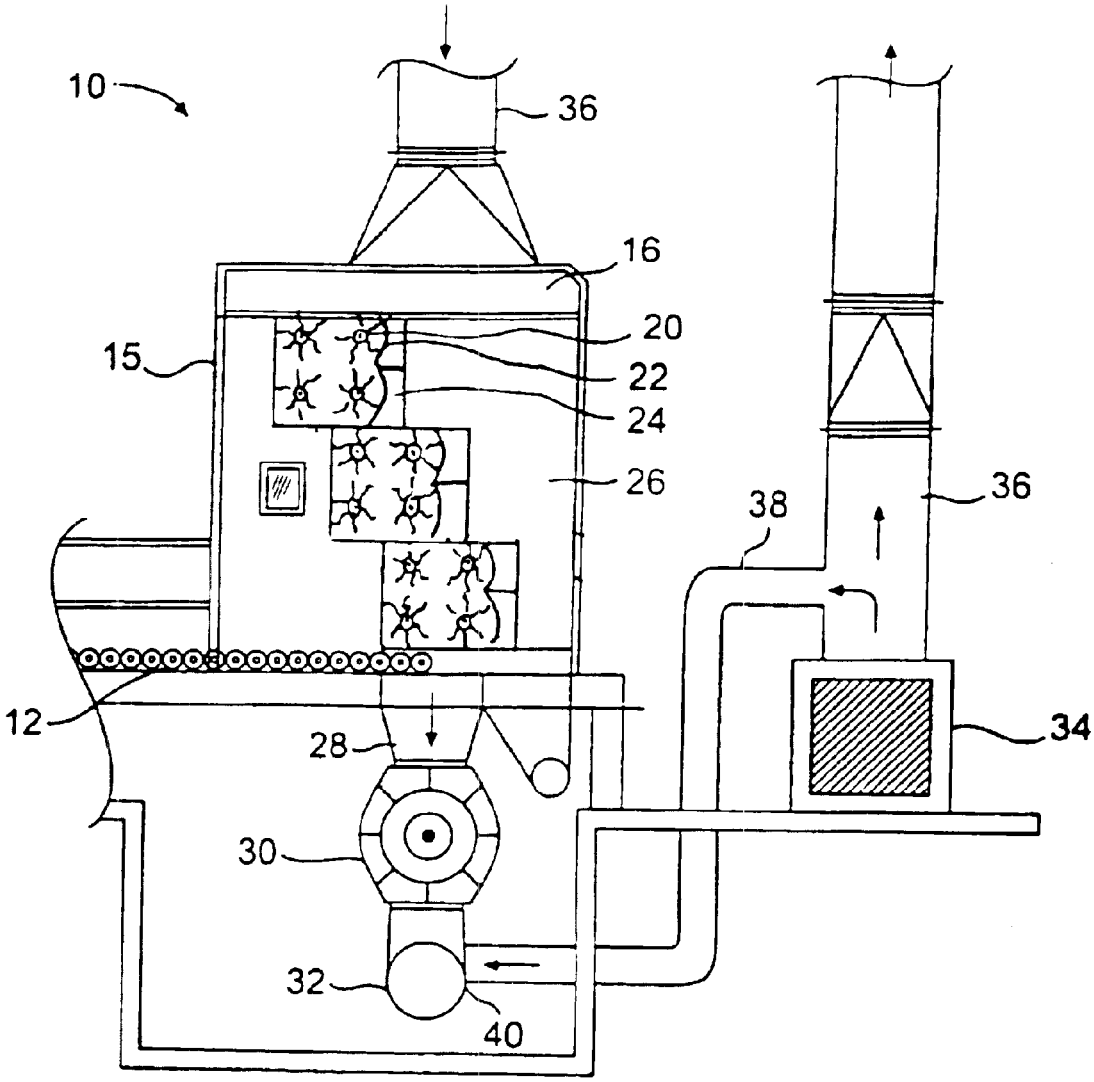
FIG. 4 is a schematic side view illustration of another preferred embodiment of a combination module feeder and cleaner according to the present invention.

In an alternative embodiment, as shown in FIG. 3, an additional cylinder 52 may be added to the first vertical column of spiked cylinders 18 for assisting the break up of the modules of seed cotton. The additional cylinder 52 may rotate in a clockwise direction as viewed in FIG. 3. However, it is also contemplated that the additional cylinder 52 may operate effectively when rotating in a counterclockwise direction as viewed in FIG. 3. In another alternative embodiment, as shown in FIG. 4, the cylinders of the first vertical column of spiked cylinders 18 and the cylinders of the second vertical column of spiked cylinders 20 may have centers offset with respect to the other cylinders in their respective columns.

Figure 7:
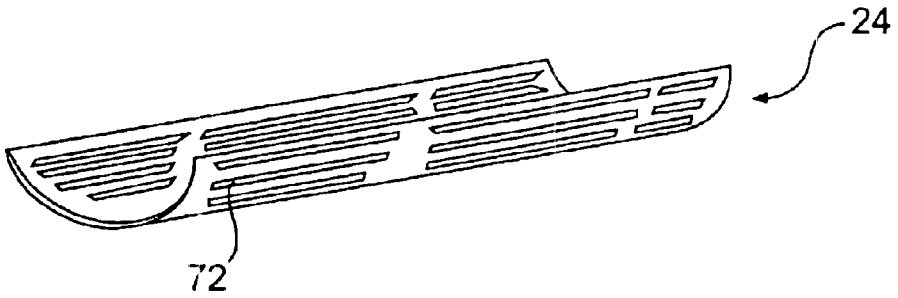
FIG. 7 is a perspective view of a grid as incorporated in the present invention.
Figure 8:
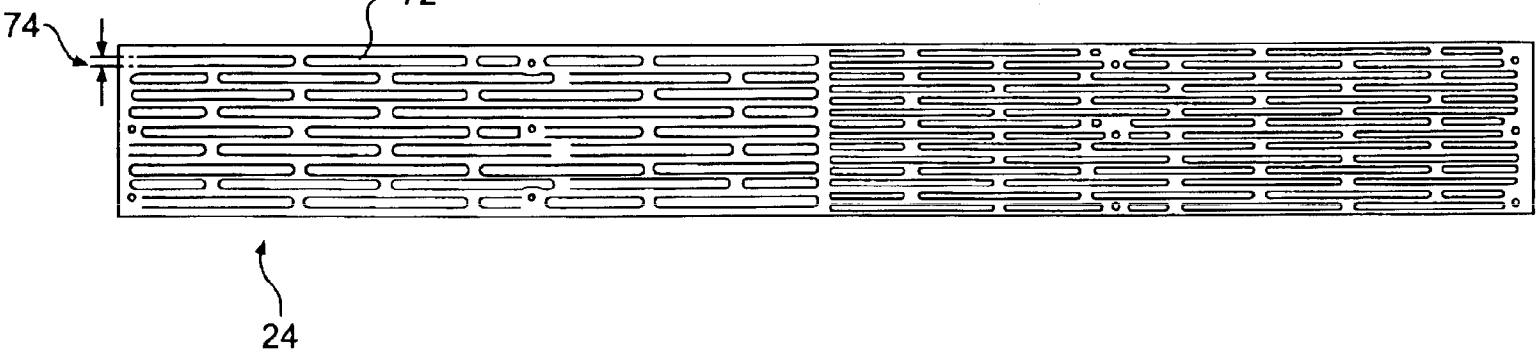
FIG. 8 is a schematic top view illustration of the grid as incorporated in the present invention.

As depicted in FIGS. 5, 7, and 8, the grid 24 is also preferably concave in structure and includes spaced slots 72. FIG. 8 illustrates a preferred configuration of the spaced slots 72. In contrast to conventional systems, the design and construction of the grid 24 allows for its rapid removal and replacement in the saddle 22. Preferably, grid 24 is constructed from a single sheet of flat metallic material, typically steel, where the dimensions of the steel sheet permit the grid 24 to traverse the depth of casing 16.

In a preferred manufacturing process of the grid 24, the design of the grid surface (i.e. configuration of spaced slots 72) is first selected and created using a computer-aided drawing software package. Once the design pattern is formalized, the file storing the design is reformatted, so that it may be processed by a computer of a plasma cutter or similar machining tool. After processing the design file and receiving certain characteristic information on the steel sheet, such as the particular type of steel and the dimensions of the sheet, the machining tool cuts the design pattern on the steel sheet. The flat sheet of steel is then removed from the machining tool and transported to a rolling station. Preferably, the degree of curvature assigned to grid 24 is substantially identical to the curvature of its respective saddle 22.

Once sufficiently rolled, grid 24 may be inserted in the casing 16 in a chosen set of saddles. A series of saddles are preferably disposed across the depth of casing 16, where each saddle is positioned at distinct intervals so as to provide adequate support for grid 24. Alternatively, grid 24 may be supported by a single saddle extending across the depth of casing 16. Regardless of the saddle configuration, grid 24 may be rapidly removed and inserted in the saddle by simply sliding grid 24 along the surface of the saddle(s) 22. As will be discussed, this ability to rapidly remove and replace grid 24 proffers to the cotton ginner a number of previously unobtainable benefits.

Figure 9:
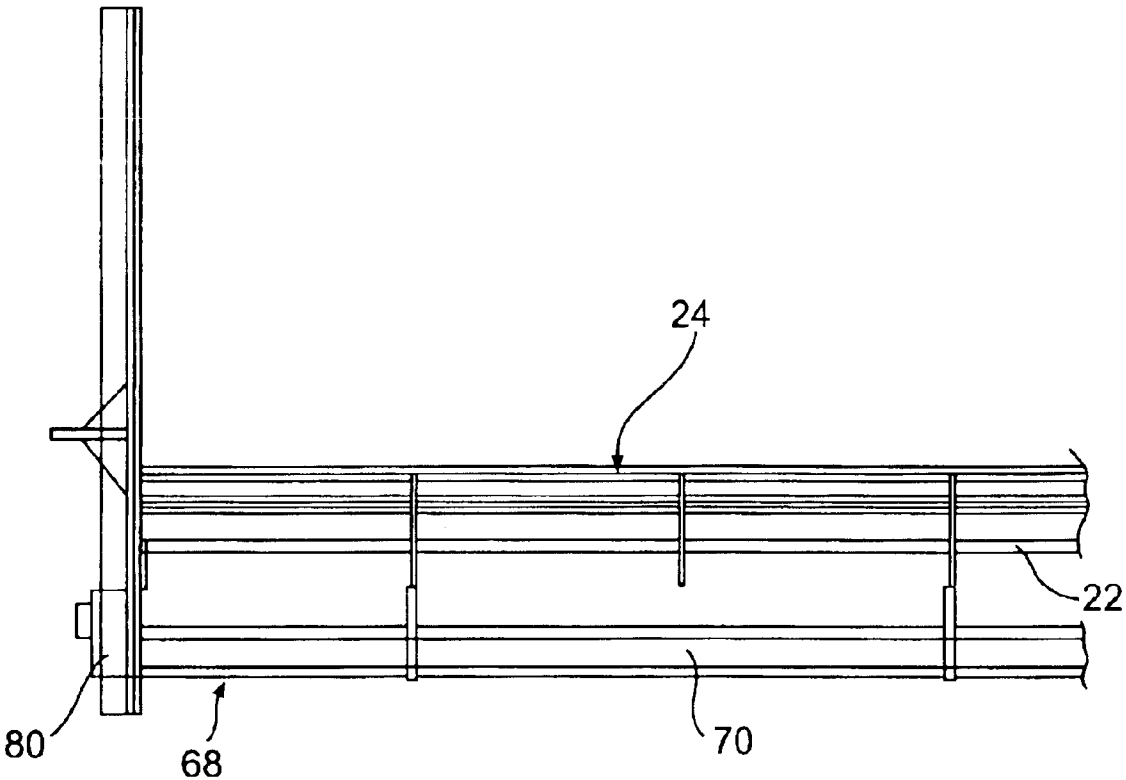
FIG. 9 is a fragmentary front view illustration of a portion of the saddle, grid, port, and tray as incorporated in the present invention.
Figure 10:
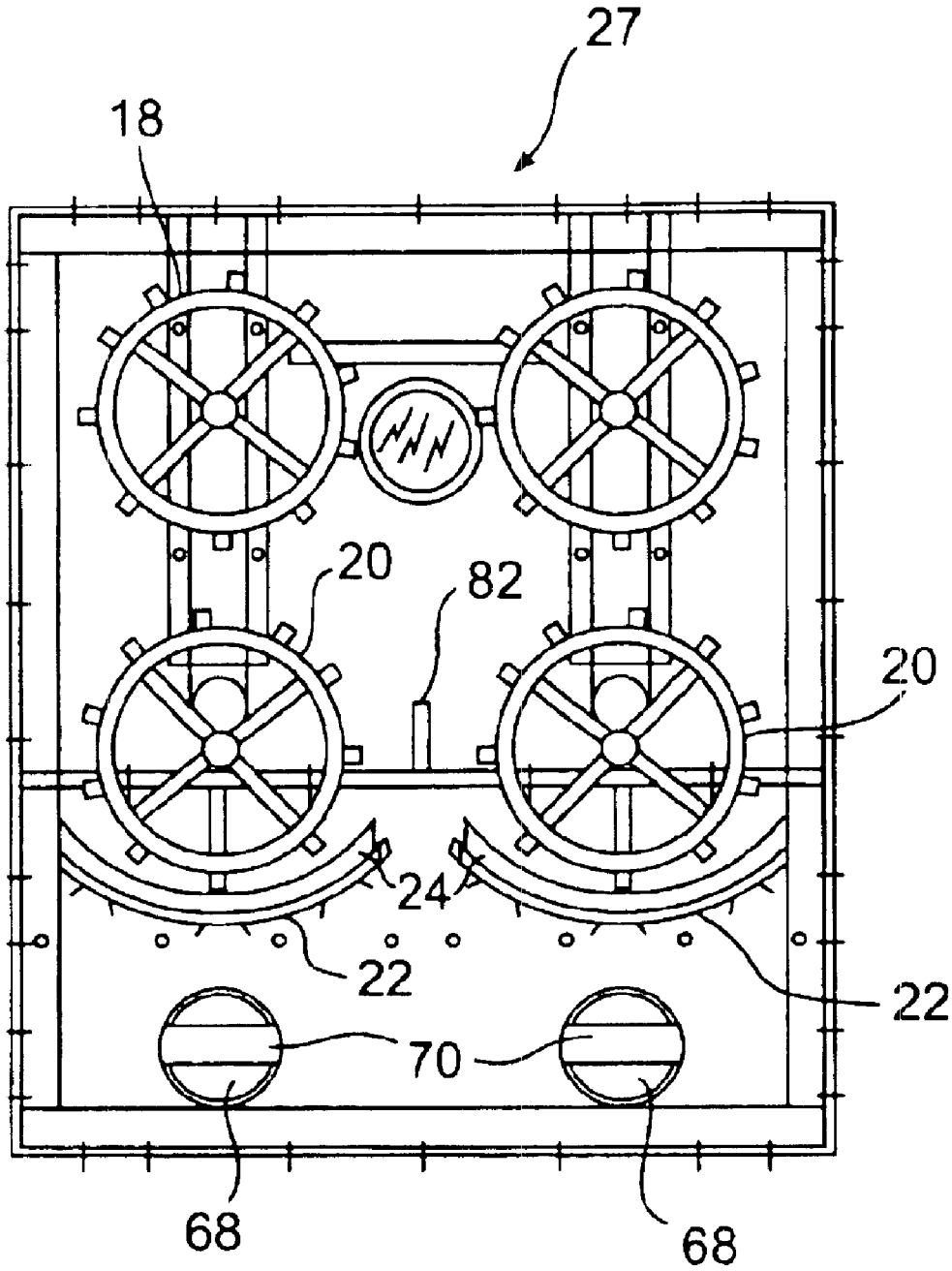
FIG. 10 is a schematic side view illustration of a saddle, grid, port, and tray as incorporated in the present invention.
Figure 11:
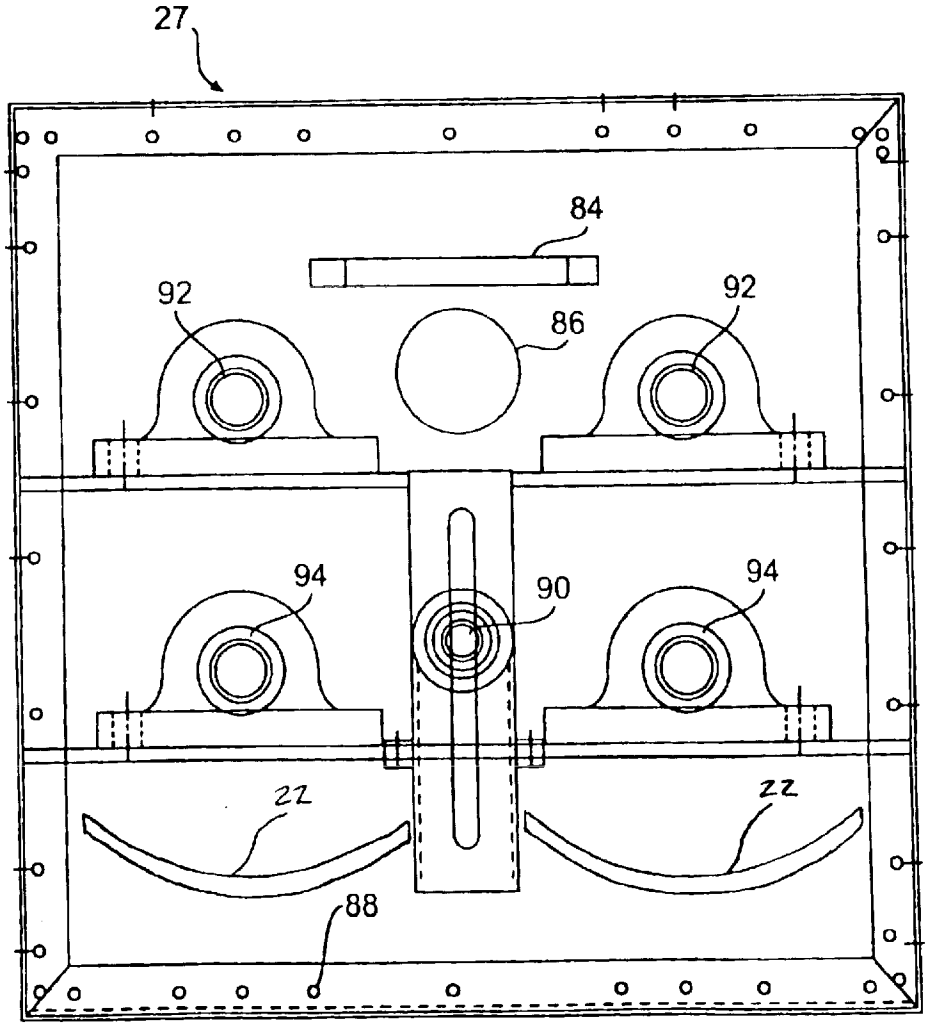
FIG. 11 is a front view illustration of a module as incorporated in the present invention.

As depicted in FIGS. 5, 10, and 11, in module 27, positioned substantially adjacent each saddle 22, are ports 68. As depicted in FIG. 5, modules 27 are provided with apertures 62 for accommodating the spiked cylinders of first vertical column of spiked cylinders 18, and apertures 64 for accommodating the cylinders of the second vertical column of spiked cylinders 20. As depicted in FIG. 9, each port 68 may extend adjacent grid 22 and is configured to house a tray 70 as well as permit the removal and insertion of the tray 70 in the port 68. Port 68 includes an open upper surface so that the tray 70, once inserted, may receive and retain a representative sample of objects descending through spaced slots 72 of grid 24. Preferably, each port 68 has an openable end portion 80 constructed of a transparent material to permit visual inspection of the objects descending through spaced slots 72.

Returning to FIG. 1, as the high density seed cotton descends through the cylinders, spikes, positioned along the perimeter of each cylinder, initially receive the seed cotton. The rotation of the cylinders and corresponding spikes swipe the seed cotton along spaced slots 72 of the grids 24, thereby removing trash and other objects from the seed cotton by releasing these objects through the spaced slots 72 of grids 24. As the seed cotton is separated from the trash, the cotton tends to fall between the columns of cylinders and to the outlet 28 of the casing 16, where it can be collected or conveyed to downstream cotton processing machinery. Meanwhile, the trash will advantageously exit though the slots 72 of the grids 24 into the cavity 26 where it drops into a receiving chamber where it can be removed.

The design and configuration of the combination module feeder and cleaner enables various changes in the cleaning elements, where these changes can produce optimal results for the particular seed cotton being cleaned. For example, the transparent characteristic of end portion 80 of the port 68 allows for the continued visual inspection of the objects removed from the seed cotton by grid 24. From this visual inspection, the ginner may determine that a grid having a different spaced slot configuration may be more effective in the cleaning process. Because of the rapid removability and replacement of grid 24, installation of the more effective grid may occur without unduly delaying the cleaning process. To remove grid 24 from its respective saddle 22, the ginner need only slide grid 24 out of the saddle 22. Similarly, a different grid of an improved spaced slot configuration may be inserted into the vacant saddle by simply sliding the grid in the saddle. Thus, because of the design of grid 24, the ginner may easily and rapidly replace a particular grid 24 and its spaced slot configuration 72 in response to the characteristics of the objects removed from the seed cotton. Such control enhances the seed cotton's desirability without unduly delaying the ginning process.

Alternatively, assuming a more detailed inspection of the removed objects is desired, a tray 70 may be removed from its corresponding port 68 to permit a physical inspection of the removed objects. Tray 70, inserted in the port 68 and positioned substantially adjacent grid 24, receives and retains a representative sample of the objects removed from the seed cotton. To remove tray 70 from the port 68, the ginner need only slide tray 70 out of the openable end 80 of the port 68. Once tray 70 is removed and a detailed inspection of the objects received in tray 70 is completed, the ginner may determine, with increased accuracy, that a grid of a different spaced slot configuration may be more effective in the cleaning process. As previously described, the ginner may immediately replace the grid 24 and its particular spaced slot configuration in response to the characteristics of the objects removed from the seed cotton.

In addition to the improved quality of the processed cotton, the increased control offered by the combination module feeder and cleaner of the present invention allows the ginner to combine the processing steps of the conventional module feeder, the conventional cleaner, and conventional extractor, into one machine.

The combination module feeder and cleaner of the present invention further offers a modular design that permits the addition or removal of a set of cleaning elements as the ginner desires. The configuration of casing 16 allows it to receive one or more modules 27. Because module 27 has neither a predetermined inlet or outlet, its design permits any number of modules 27 to be added or removed from any position in the casing 16. As illustrated in FIG. 10, each module 27 includes two rotating spiked cylinders from the first vertical column of spiked cylinders 18; two rotating spiked cylinders from the second vertical column of spiked cylinders 20 located adjacent grids 24 that are positioned in saddles 22; adjustable vanes 82 positioned between the cylinders of the second vertical column of spiked cylinders 20; and ports 68 respectively positioned adjacent each saddle 22 and configured to house trays 70.

As illustrated in FIGS. 5, 10, and 11, the configuration of casing 16 and module 27 allow for the insertion of module 27 adjacent an adjoining module 27. As shown in FIG. 11, each module 27 may be provided with two pairs of bearings 92 and 94 for receiving spiked cylinders, a handle 84 for assisting with handling of the module 27, a viewing port 86, an adjustable idler 90, and a bolt system including a series of bolt holes 88 disposed along the edges of the module 27, where each bolt hole 88 is configured to receive a bolt (not shown). Because the pattern of locations of the bolt holes 88 on a given module 27 are identical, any number of modules 27 may be secured together. Use of this bolt system permits the ginner to insert and fasten additional modules 27 to any respective adjoining structure without the need for welding or other machining. For example, to insert an additional module 27 into casing 16, the ginner would first unbolt an existing module 27 from one of its adjoining structures and sufficiently separate the existing module 27 from its adjoining structure to allow for the insertion of an additional module 27. After inserting additional module 27 and aligning the respective bolt patterns, new module 27 may be securely bolted in place. If the ginner instead desires to remove an existing module 27 from casing 16, the ginner need only unbolt and remove existing module 27 from casing 16, reposition the remaining module structures adjacent one another, and securely bolt them in place. Although the above disclosure and associated drawings disclose only the preferred bolt system, alternative systems may be used which possess similar fastening characteristics.

This ability to easily add or remove a module allows the ginner to clean seed cotton with enhanced control without unduly delaying the ginning process. If the ginner determines that the seed cotton requires additional cleaning, the ginner need only insert an additional module or modules that include the cleaning characteristics desired. Alternatively, if the seed cotton is being exposed to unnecessary machining, the ginner may simply remove a module or modules from the existing configuration. Regardless of the particular needs, the modular design of the combination module feeder and cleaner of the present invention allows the ginner to customize the cleaner in order to produce a more desirable cotton.

As described above, the construction of the combination module feeder and cleaner of the present invention enables the ginner to break apart modules of seed cotton and extract undesirable objects, such as burrs and sticks, and small objects, such as dirt and leaf, in a single machine. The ginner may maximize the cleaning characteristics of the combination module feeder and cleaner by adapting the grids to better correspond with the needs of the particular seed cotton, by simply inspecting the objects extracted by the grids. Furthermore, because of the modular capabilities of the combination module feeder and cleaner, the ginner may manipulate, add, or remove a set of cleaning elements in response to the characteristics of the seed cotton.

Although the previous description speaks of only seed cotton, the combination module feeder and cleaner of the present invention is not limited to the breaking apart of and the cleaning of modules of seed cotton. Indeed, the combination module feeder and cleaner may be used to process modules of cotton that have already had the seed removed as well as trash and other objects. In essence, the adaptability of the combination module feeder and cleaner permits it to process various products possessing similar properties and cleaning characteristics as seed cotton. These other products may include, for example, cellulose or synthetic fibers, or non-cotton-like products such as hay and rubber.

It will be apparent to those skilled in the art that various modifications and variations can be made in the combination module feeder and cleaner of the present invention and in construction of this device without departing from the scope or spirit of the invention. For example, the columns of cylinders of the exemplary embodiment illustrated may be alternatively arranged in horizontal rows without departing from the scope of the invention.

Other embodiments of the invention will be apparent to those skilled in the art from consideration of the specification and practice of the invention disclosed herein. It is intended that the specification and examples be considered as exemplary only with a true scope and spirit of the invention being indicated by the following claims.

What is claimed is:

1. A combination module feeder and cleaner for use in a cotton gin for breaking apart modules of seed cotton and removing objects from modules of seed cotton, the combination module feeder and cleaner comprising:

a casing having an inlet for receiving modules of seed cotton, and an outlet for expelling the seed cotton after a module of seed cotton has been broken apart and objects have been removed;

a conveyer for moving modules of seed cotton into the inlet;

a first column of rotatable cylinders positioned adjacent the inlet;

a second column of rotatable cylinders positioned adjacent the first column of rotatable cylinders;

a saddle positioned adjacent at least one of the rotatable cylinders of the second column of rotatable cylinders; and a grid positioned in the saddle, the grid having spaced slots through which objects pass when removed from the seed cotton.

2. The combination module feeder and cleaner of claim 1, wherein the grid is slidably removable.

3. The combination module feeder and cleaner of claim 1, further comprising at least one removable module, wherein the removable module houses at least one cylinder of the first column of rotatable cylinders and at least one cylinder of the second column of rotatable cylinders.

4. The combination module feeder and cleaner of claim 3, wherein the combination module feeder and cleaner comprises at least one pair of cylinders of the first column of rotatable cylinders and at least one pair of cylinders of the second column of rotatable cylinders, wherein each removable module houses one pair of cylinders from the first column of rotatable cylinders and one pair of cylinders of the second column of rotatable cylinders.

5. The combination module feeder and cleaner of claim 1, further comprising a vacuum for moving warm air through the casing to remove moisture from the seed cotton.

6. The combination module feeder and cleaner of claim 5, further comprising a burner and a duct, wherein the burner and the duct provide the warm air.

7. The combination module feeder and cleaner of claim 1, further comprising a port positioned adjacent the saddle, the port being configured to receive a tray.

8. The combination module feeder and cleaner of claim 7, further comprising a transparent cover over the port.

9. The combination module feeder and cleaner of claim 1, wherein the first column of rotatable cylinders comprises one more cylinder than the number of cylinders of the second column of rotatable cylinders.

10. The combination module feeder and cleaner of claim 1, wherein the rotatable cylinders of the first column of rotatable cylinders have centers offset with respect to each other, and the rotatable cylinders of the second column of rotatable cylinders have centers offset with respect to each other.

11. The combination module feeder and cleaner of claim 1, wherein the rotatable cylinders of the first column of rotatable cylinders have centers offset with respect to the rotatable cylinders of the second column of rotatable cylinders.

* * * * *